US007313935B2

(12) United States Patent
Ronchi

(10) Patent No.: US 7,313,935 B2
(45) Date of Patent: Jan. 1, 2008

(54) DYING OR BLEACHING APPARATUS FOR YARN WOUND ON REELS OR SIMILAR PACKAGES

(75) Inventor: Francesco Ronchi, Sovico-Milan (IT)

(73) Assignee: Master S.a.S. di Ronchi Francesco & C., Macherio, Milan (IT)

( * ) Notice: Subject to any disclaimer, the term of this patent is extended or adjusted under 35 U.S.C. 154(b) by 602 days.

(21) Appl. No.: 10/476,672

(22) PCT Filed: May 24, 2002

(86) PCT No.: PCT/EP02/05743

§ 371 (c)(1),
(2), (4) Date: Nov. 4, 2003

(87) PCT Pub. No.: WO02/095113

PCT Pub. Date: Nov. 28, 2002

(65) Prior Publication Data

US 2004/0139769 A1 Jul. 22, 2004

(30) Foreign Application Priority Data

May 25, 2001 (IT) ..... MI2001A1115

(51) Int. Cl.
*D06F 17/00* (2006.01)

(52) U.S. Cl. ..... 68/194; 68/148; 68/150; 68/184; 68/189

(58) Field of Classification Search ..... 8/154, 8/155, 55.1, 155.2; 68/148, 150, 184, 189, 68/198, 194

See application file for complete search history.

(56) References Cited

U.S. PATENT DOCUMENTS

| | | | | |
|---|---|---|---|---|
| 1,327,662 A | | 1/1920 | Dudley | |
| 3,760,614 A | * | 9/1973 | Bergholtz | 68/189 |
| 5,323,629 A | * | 6/1994 | Aurich et al. | 68/27 |
| 5,477,709 A | * | 12/1995 | Rowe | 68/212 |

FOREIGN PATENT DOCUMENTS

| | | | |
|---|---|---|---|
| DE | 24 51 829 | | 5/1976 |
| JP | 49-87869 | * | 8/1974 |
| WO | WO 99/16953 | | 8/1999 |

* cited by examiner

*Primary Examiner*—Michael Barr
*Assistant Examiner*—Jason Heckert
(74) *Attorney, Agent, or Firm*—Hedman & Costigan P.C.; James V. Costigan

(57) ABSTRACT

Dying or bleaching apparatus for yarn wound on reels or similar packages, comprising a plurality of small vertical dying boilers (15) arranged on a single circumference each suitable for receiving a mobile reel holder shaft (13) which can be removed at the same time as the others for the subsequent centrifugal water draining and drying operations, operating with less liquid and also capable of being used with fractional capacities with a constant soaking ratio.

10 Claims, 8 Drawing Sheets

DYING OR BLEACHING APPARATUS FOR YARN WOUND ON REELS OR SIMILAR PACKAGES

The present invention refers to a dying or bleaching apparatus for yarn wound on reels or similar packages. Traditional dying or bleaching apparatuses for yarn consist of a vertical boiler, equipped with a pump and devices for the reversible circulation of a treatment liquid. Such apparatuses have a universal use since they are suitable for receiving material holders for the different possible packages of yarn.

Specifically just for reels or similar packages, apparatuses consisting a series of small horizontal boilers, arranged one next to the other or one on top of the other, so as to form a parallelepiped structure.

Each of these small boilers can receive a reel holder shaft which usually has a tubular structure. Such a shaft, for constructive cost-effectiveness, generally carries from ten to twelve reels, according to the length of their perforated support.

These apparatuses, with respect to the traditional ones, have the advantage of operating with a very short soaking ratio and moreover they need neither an installation space nor a hoist to move it.

However, they have a series of problems regarding dying <of a single boiler provided with a plurality of vertical tubes for housing reels are used.

Such as boiler structure, disclosed for example in the U.S. Pat. No. 3,760,614, provided a reduction in the soaking ratio but inadequate for the actual requirement of dying industry.

Alternatively are used special apparatuses comprising> quality, practicality of the reel loading and unloading operations, and moving the reel holder shafts in general.

Indeed, the operator must slot in the reels one above the other on the individual shafts arranged with their axis vertical. Since the small boilers are horizontal, to slot in such shafts, which are loaded with reels and are therefore very heavy, it is first of all necessary to position them with their axes horizontal on a trolley.

Such shafts are very long due to the large number of reels which they receive and they essentially consist of a perforated tube. Such a tube has a base hole and is perforated, on its surface, in a differentiated manner along its length in order to try to make the passage of the liquid uniform on the individual reels arranged n said shafts.

Nevertheless, abundantly and uniformly wetting the large number of reels arranged on the shafts presents substantial difficulties; moreover, it is very probable that some reels have a substantially different density to the others, thus contributing to unevening the wetting passage.

For this reason and for others inherent to the circulation system of the dying liquid, these apparatuses are not advised for dying very compact reels, for example those with cotton or viscose yarn, in particular fine yarns intended for fabrics or knitted fabrics of a single colour.

They are, therefore, complex apparatuses, with an irrational and unpractical liquid circulation, which require many manipulations of the yarn; moreover, they are expensive, they are difficult and expensive to automate, and in particular they are not very reliable in dying.

It is, therefore, clear that, apart from the advantage of the reduction of the soaking ratio, these apparatuses certainly do not represent current dying industry expectations for a dying or bleaching device for yarn wound on reels or similar packages. If the environmentally-friendly aspect is gained thanks to the short soaking ratio with which the aforementioned apparatuses operate, there is a lack in the aspects regarding the reduction of yarn manipulations, in order to reduce the impact of the workforce costs, and those linked to practicality, operative flexibility, ease of automation and above all the possibility of treating any fibre with absolute confidence.

As far as the manipulations are concerned, it is useful to recall that which the complete operating cycle foresees. It comprises the loading of the reels, slotted one above the other, on the individual shafts arranged vertically, the rotation of these shafts until a horizontal position is reached, transferring these shafts onto a loading trolley which carries the shafts in a horizontal position, positioning and clamping the trolley to the structure of the dying apparatus, pushing the shafts into the individual small boilers, detaching and removing the loading trolley, dying treatment in the small boilers, repositioning and clamping the trolley to the structure of the apparatus, removing the shafts from the individual small boilers, detaching the trolley, repositioning the individual shafts vertically, removing the reels from the shafts, dipping the reels in a water-draining apparatus, water-draining treatment to drain the maximum possible amount of water from the reels, removing the reels from the water-draining apparatus, loading the reels on the shafts of the trolley for the dryer, introducing the trolley into the dryer, drying the reels, removing the trolley with the end load of treated and dried reels.

It is therefore clear how the modern dying industry needs apparatuses which allow a reduction, if not elimination, of the manipulations of yarn in some steps of the aforementioned productive cycle, simplifying it with a consequent reduction in the production costs. Another requirement, which is urgently demanded by the market, should be added to the above, that being an ever more flexible use of these apparatuses, understood in the sense of being able to use them not just at full capacity but also, according to requirements, partly full, and this, of course, with a virtually constant soaking ratio.

The purpose of the present invention is that of realising a dying or bleaching apparatus for yarn wound on reels or similar packages, which allows the manipulations to be carried out to be minimised as far as possible.

Another purpose of the present invention is that of realising a dying or bleaching apparatus for yarn wound on reels or similar packages, which guarantees good treatment results, with a uniform and abundant treatment liquid passage in each package.

Another purpose of the present invention is that of realising a dying or bleaching apparatus which uses a very short soaking ratio, reducing atmospheric and environmental pollution and energy costs accordingly.

Yet another purpose of the present invention is that of realising a dying or bleaching apparatus which allows a good flexibility of use, maintaining a constant soaking ratio as the load of material to be treated varies.

A further purpose of the present invention is that of realising a particularly simple and functional dying or bleaching apparatus at a contained cost.

These purposes according to the present invention are achieved by realising a dying or bleaching apparatus for yarn wound on reels or similar packages, as outlined in claim 1.

Further characteristics are foreseen in the dependent claims.

The characteristics and advantages of a dying or bleaching apparatus for yarn wound on reels or similar packages, according to the present invention shall become clearer from the following description, given as an example and not for limiting purpose, referring to the attached schematic drawings in which.

Figure 1:
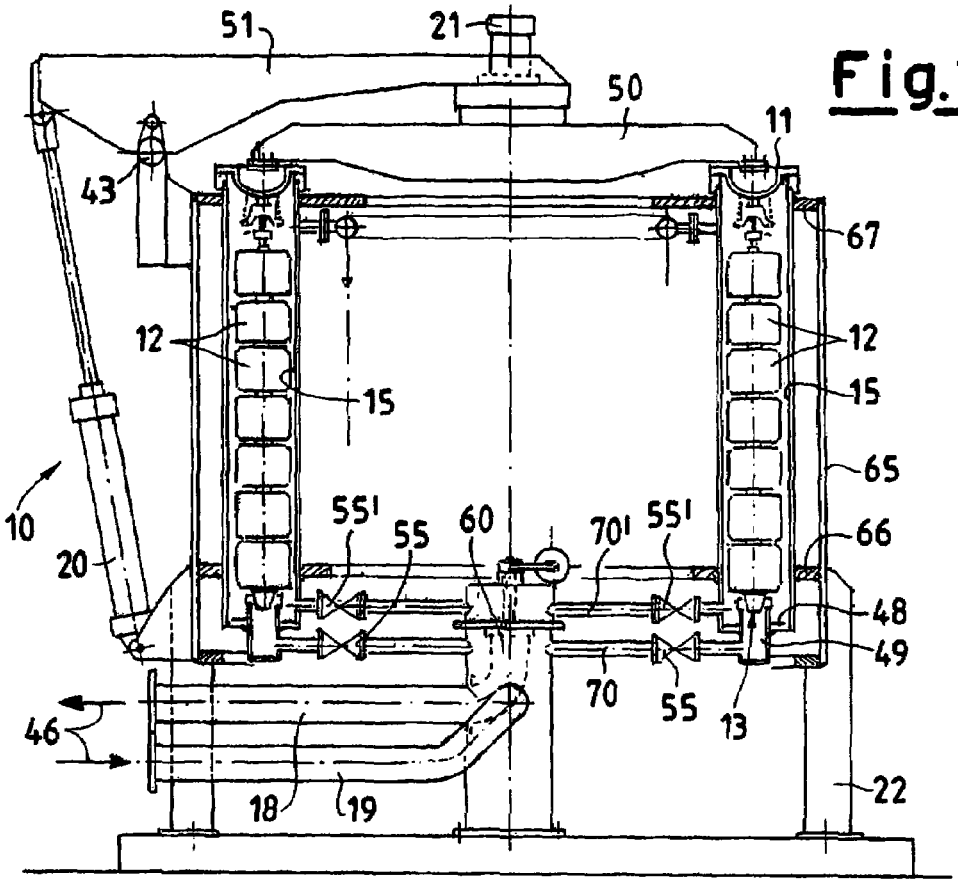
FIG. 1 is a side elevational section view of a dying or bleaching apparatus for yarn wound on reels, according to the present invention, consisting of a plurality of small vertical treatment boilers, arranged on a circumference and each containing a reel holder shaft.
Figure 7:
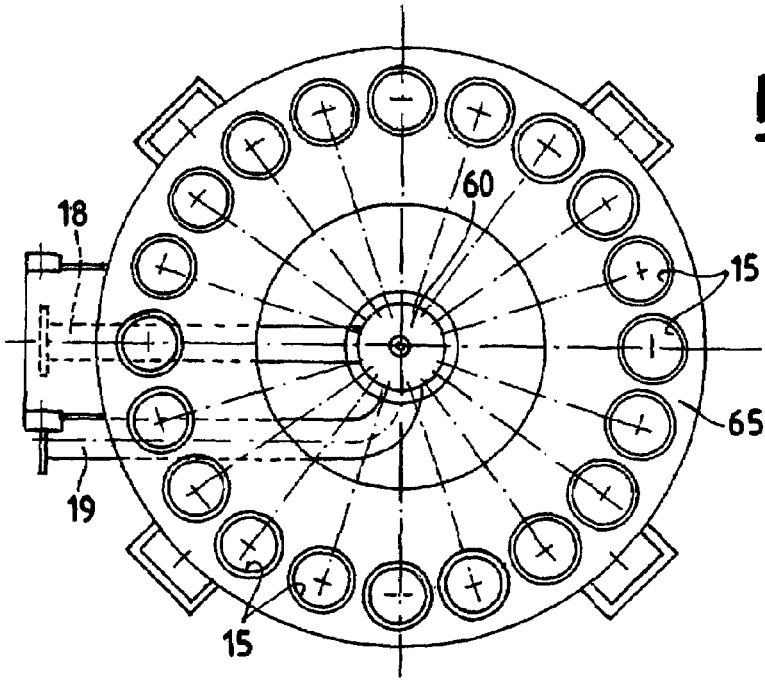
Figure 3A:
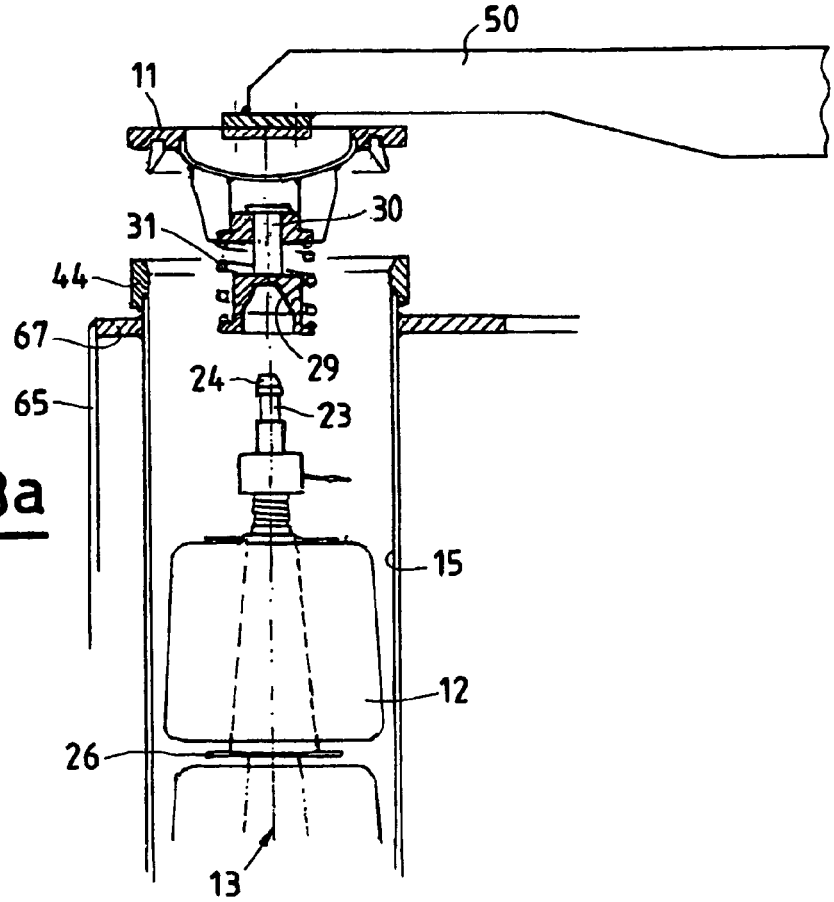
Figure 3B:
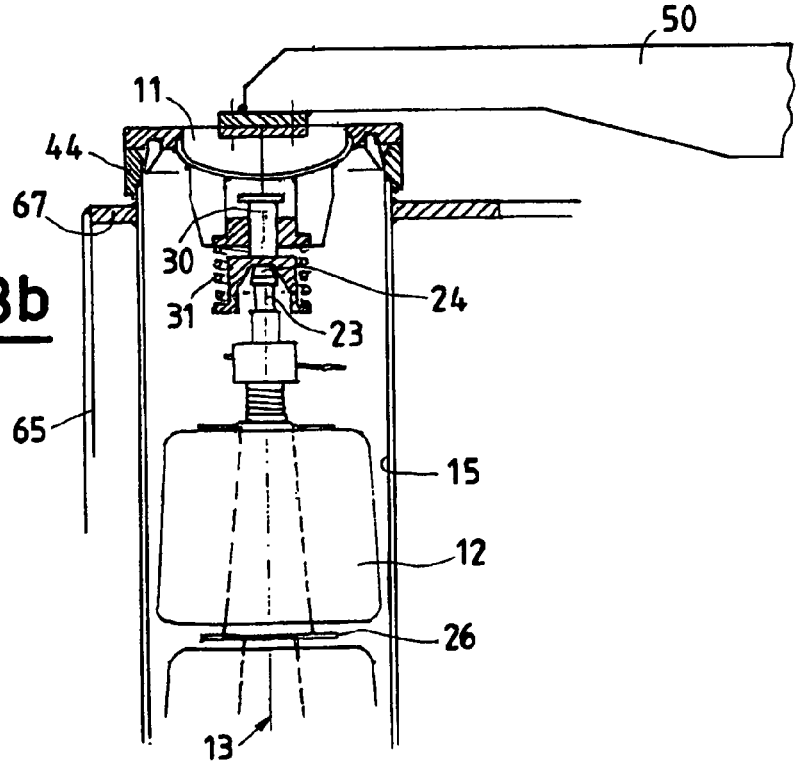
Figure 4:
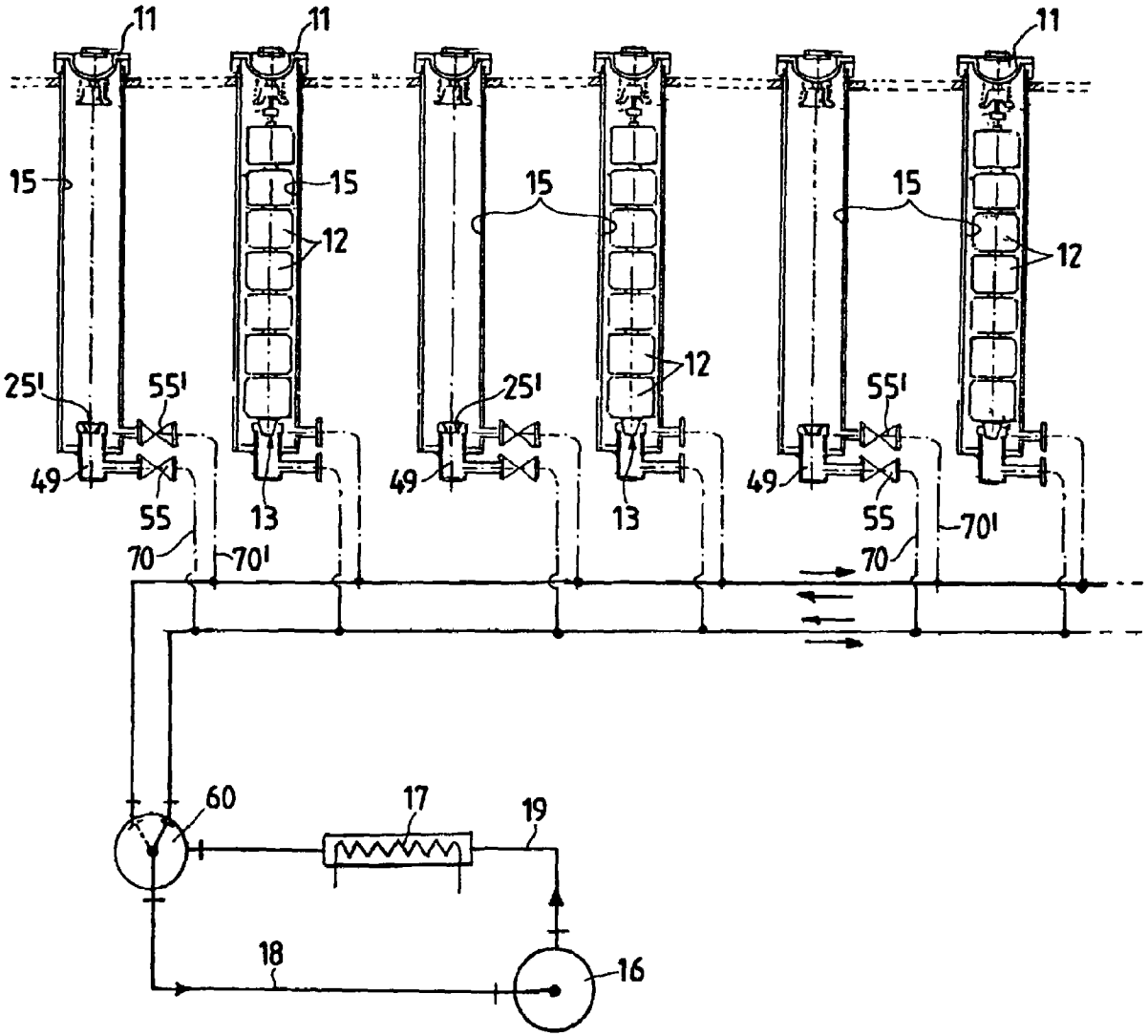
Figure 5:
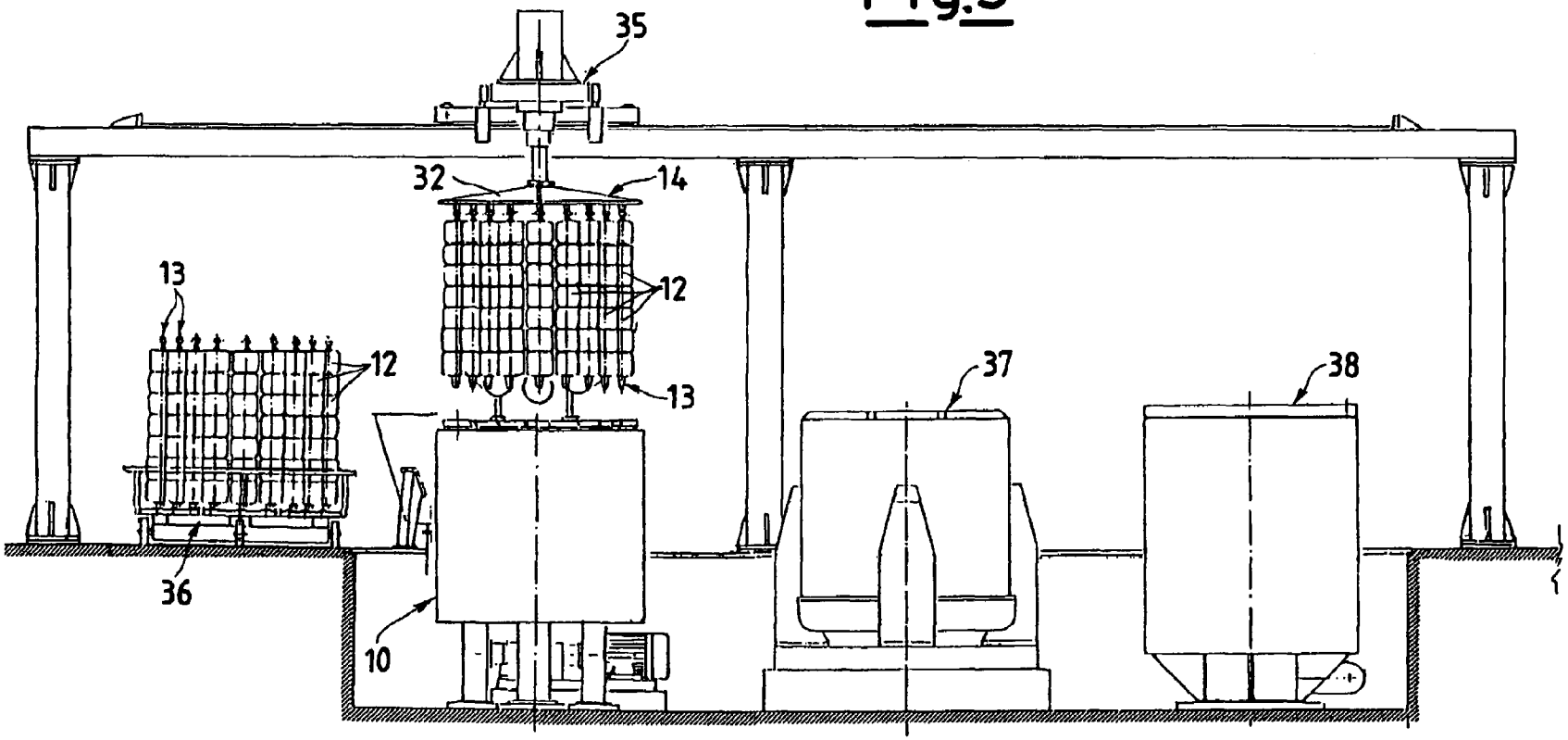
Figure 6A:
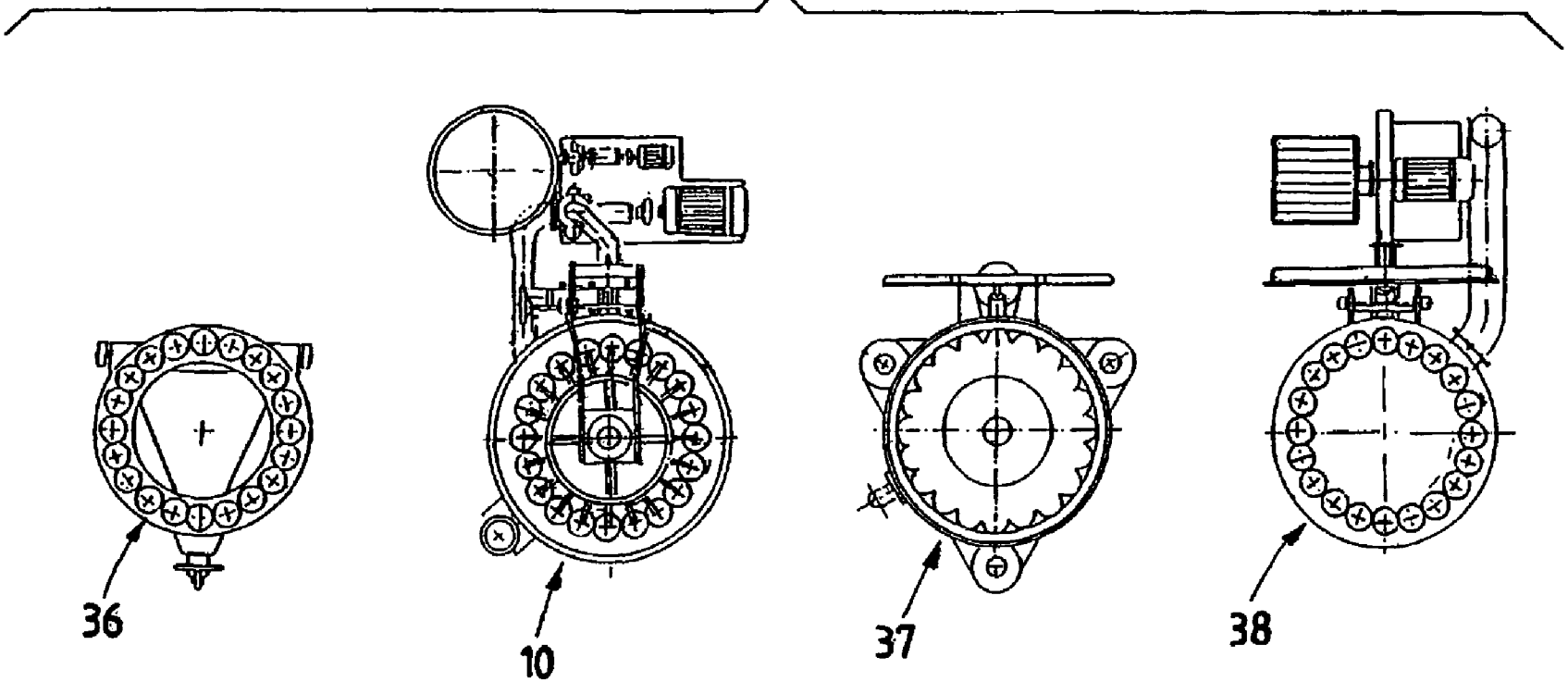
Figure 6B:
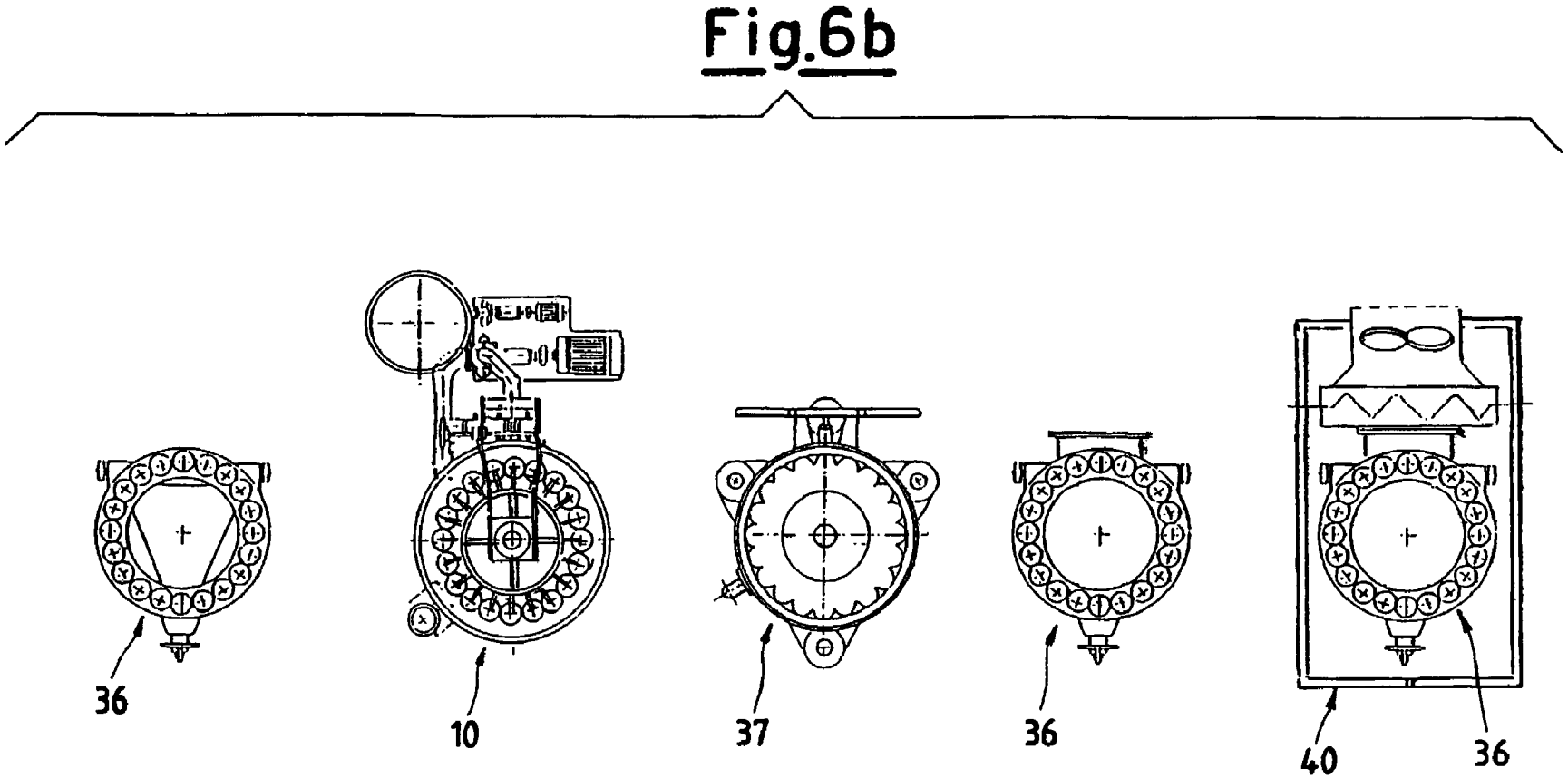
Figure 6C:
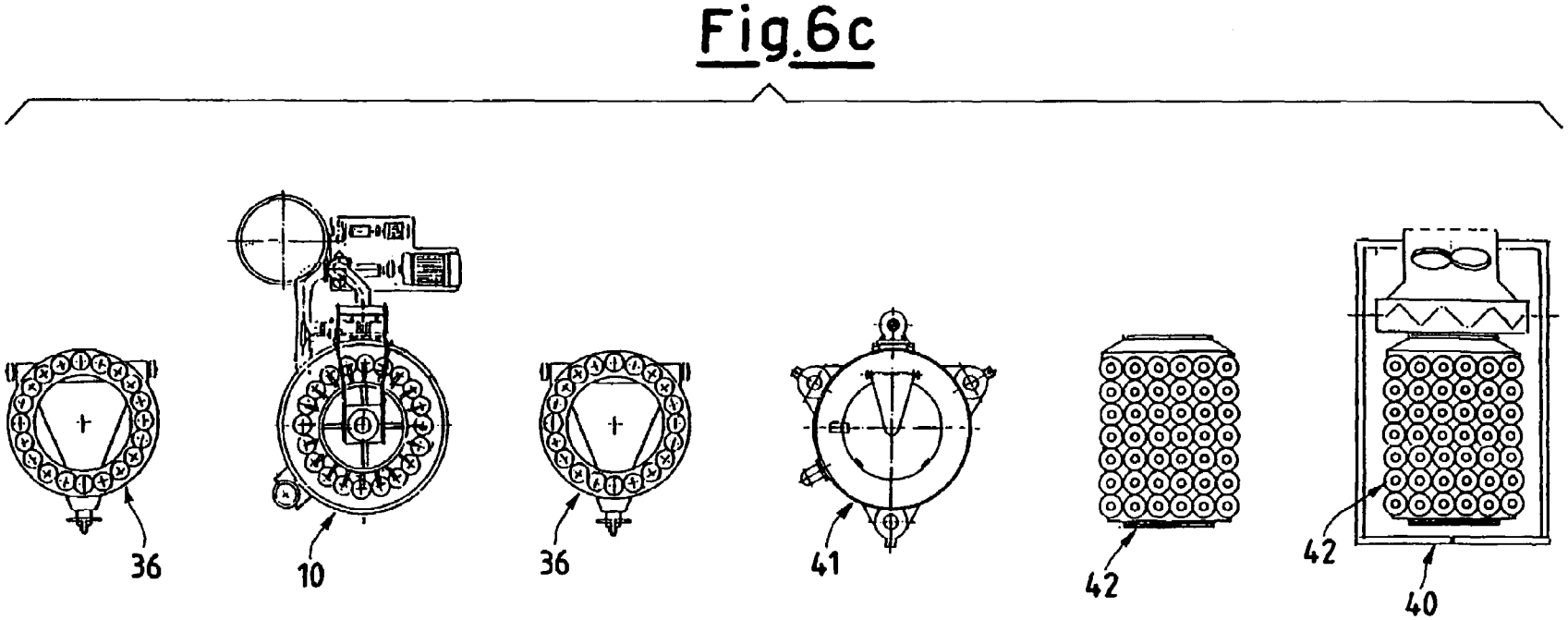

FIGS. 3*a* and 3*b* show an enlarged side elevational section view of a detail of a cover of a small boiler of the apparatus of FIG. 1, in a step prior to closing and in closed position, respectively;

FIG. 4 shows a diagram of a treatment liquid circulation, where the sections of some small boilers of the apparatus of FIG. 1 can be seen, one filled with a reel holder shaft and one empty, shut off from the circulation through valves, in alternation;

FIG. 5 shows a front view of the dying apparatus of FIG. 1, inserted in an embodiment of a dying line, upstream of a centrifugal water-draining apparatus with a tundish having a beehive section and of a drier with a chamber with a circular section;

FIGS. 6*a*, 6*b* and 6*c* show three different plan views from above of three productive embodiments of a dying line, with respective trolleys, specifically in FIG. 6*a* the line of FIG. 5 is schematised, in FIG. 6*b* a line with a traditional drier having a chamber with a rectangular section can be seen, and finally in FIG. 6*c* a line with a traditional water draining apparatus and a traditional drier is shown;

FIG. 7 shows a plan view from above of the apparatus of FIG. 1 without the cover, where the plurality of small boilers can be seen, the axes of which are arranged on a single circumference.

Before anything else it must be said that only those parts of a dying apparatus which are essential for a complete understanding of the invention are illustrated in the drawings and shall be described hereafter, whereas all accessories, such as command and control equipment, which can be realised in a traditional manner which are well known in the prior art have been left out.

Moreover, reference shall always be made to a dying apparatus, but it is to be understood that it could also concern apparatuses for bleaching or for other treatments.

With reference to the figures, a dying apparatus, with a short soaking ratio, equipped with a plurality of small vertical boilers 15 is shown wholly indicated with 10.

Such an apparatus 10 comprises a cylinder-shaped structure 65 with a vertical axis, rested on supports 22. On the inside of such a structure 65, near to the two bases of the cylinder, a lower ring 66 and an upper ring 67 are welded which support a plurality of small cylinder-shaped treatment boilers 15 with a vertical axis, the axes of which are arranged on a single inner circumference of the structure 65, concentric with its axis, as can be seen in FIG. 7.

The small cylindrical boilers 15 are equipped with a base 48 and are open at the top. They are closed through a series of circular covers 11, mounted on an annular covering structure 50, and arranged with the centres on a single circumference. Such a circumference is the same as the one on which the axes of the small boilers 15 are arranged.

The annular structure 50 is supported at its centre by an end of a lever 51, pivoted with a pin 43. The lever 51 is actuated by a flip-over cylinder 20, applied to the other end. Moreover, the structure 50 is axially equipped with a cylinder 21.

A device for circulating a dying liquid, according to the direction indicated by arrows 46, is foreseen. The device comprises in order, as seen in FIG. 4, an outer pump 16, a heat exchanger 17 for cooling and heating the liquid, and a flow inverter 60 arranged on the axis of the apparatus 10. The flow inverter 60 is connected to each small boiler 15 with two pipings 70 and 70'.

The base 48 of each small boiler 15 is equipped at the centre with a cylindrical sump 49. The sump, at a lower end, is connected to the piping 70. On the other end, on the other hand, it terminates with inverted cone-shaped seats 25'.

Figure 2:
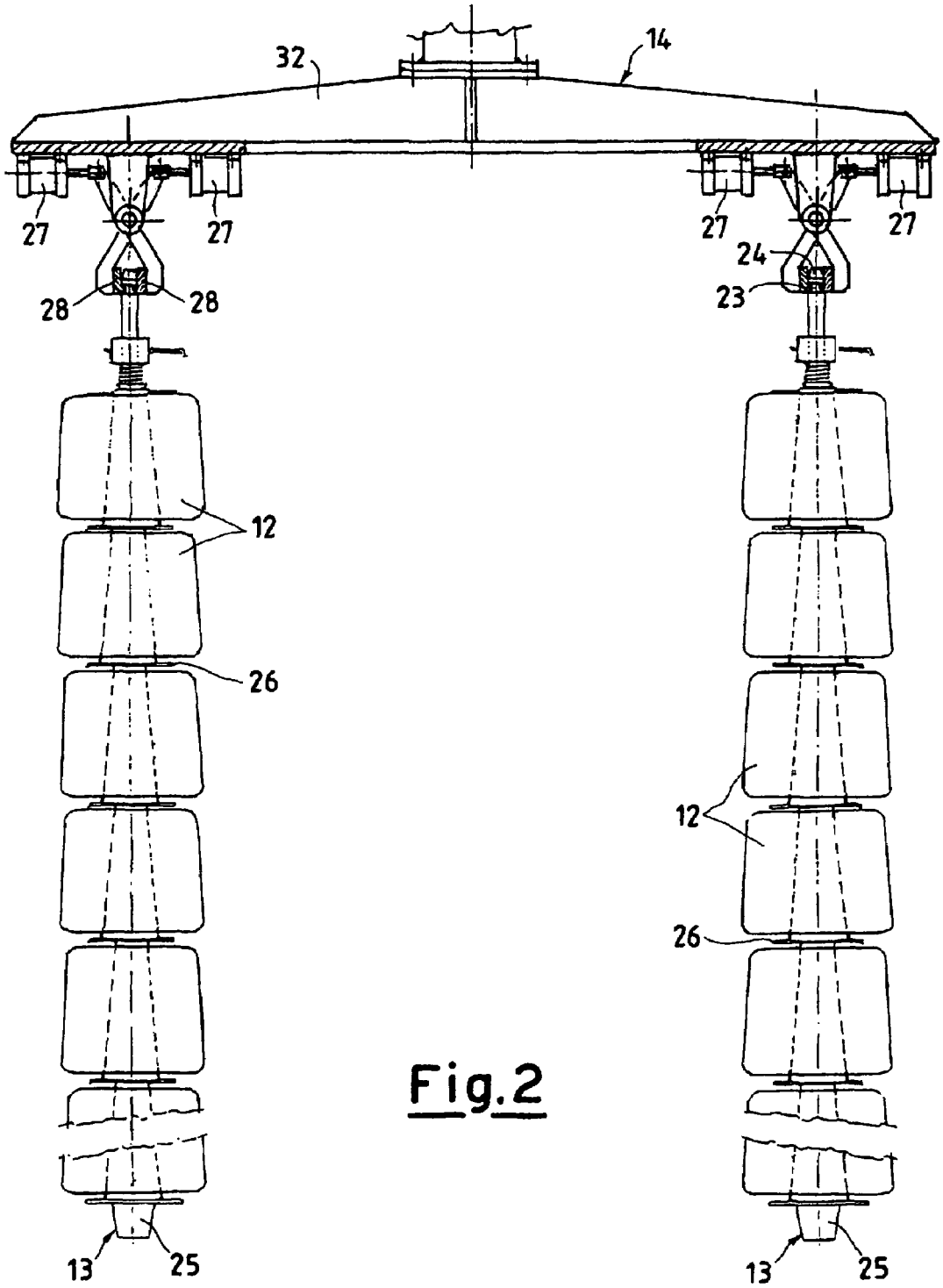
FIG. 2 shows an enlarged side elevational section view of a device for moving all of the reel holder shafts, carrying just two shafts for the sake of simplicity.

Such seats host a conical lower end 25, which can be seen in FIG. 2, of reel holder shafts 13, on which reels 12 to be treated are slotted. In the case of FIG. 2 the reels 12 are wound on conical perforated supports and are separated by spacer disks 26. In the case of reels 12 wound on special cylindrical perforated supports the disks 26 can also be left out.

FIG. 2 shows a circular device 14 for moving all of the shafts 13 arranged around the circumference, comprising a structure 32 which carries attachments for locking all the shafts 13, each consisting of a pair of small pistons 27, or of other known systems, which push two pincers 28 in correspondence with a grooved upper end 23—which can be seen in FIGS. 3*a* and 3*b*—of the shaft 13.

In FIG. 3*a* and 3*b* a detail of a lock of a cover 11 on an upper edge of a small boiler 15 is shown.

On each cover 11 locking and centring devices of the shafts 13 are foreseen. Such devices consist of a pin 30, equipped with a spring 31, which terminates with a conical seat 29, suitable for receiving the shaft 13 which terminates on top with a countersink 24.

In FIG. 4 a diagram of a treatment liquid circulation is shown, with small boilers 15 of the apparatus 10 alternately filled with reel holder shafts 13. The small boilers 15 which do not contain the shafts 13 are shut off from the circulation through valves 55 and 55' which intercept the tubes 70 and 70'.

FIG. 5 shows, under a crane 35, a dying line consisting of a trolley 36 which carries a series of shafts 13, arranged on a circumference, of the dying apparatus 10, of a centrifugal water draining apparatus with beehive hoists or perforated tubes 37 and of a drier with a chamber having a circular section 38.

In FIGS. 6*a*, 6*b* and 6*c* other embodiments of the dying line are shown, in which, in addition with respect to FIG. 5, a traditional drier with a chamber having a rectangular section 40, a traditional water draining apparatus 41, and a rectangular trolley 42 which carries a series of fixed shafts, should be noted.

The reels 12 to be dyed, wound on the conical perforated supports, are slotted into the shafts 13, separated by disks 26. These shafts 13 are positioned on the trolley to then, all together, through the device 14, be loaded into the dying apparatus 10.

In particular, said shafts 13 are positioned in the small boilers 15, which, as can be seen in FIG. 1, have an inner diameter which is slightly greater than the maximum diameter of the reels 12.

The circumferential series of seats 25' are sized to receive the conical lower ends 25 of the shafts 13. Advantageously, a series of shafts 13, in the example in the figure there are twenty, can be positioned simultaneously, to fill all of the small boilers 15, by using the moving device 14.

Such a device 14 has a circular structure 32 which comprises a series of pairs, one for each shaft 13, of small pistons 27, or other known means, arranged along the same circumference as the one which passes through the centre of the small boilers 15. The small pistons 27 can be actuated to clamp or release the grooved upper end 23 of the shafts 13 themselves, through the pincers 28, connected through levers to the small pistons 27, which can engage in the grooved ends 23.

As can be seen in FIG. 5, the device 14 clamps all of the shafts 13 arranged around the circumference for example on the trolley 36, on the same circumference as the one which passes through the centre of the small boilers 15, and lowers them from above into the dying apparatus through the crane 35.

Once the shafts 13 are inserted in the seats 25', the covering structure 50 is closed with two distinct movements, actuated by the two cylinders 20 and 21. The cylinder 20 actuates a flip-over of the lever 51 about the pin 43, into a position indicated in FIG. 3*a*.

Then the cylinder 21 carries out the axial lowering of the structure 50 which carries the individual covers 11, so as to allow a simultaneous closing of all of the small boilers 15 of the apparatus 10. In this step the locking of the shafts 13 in their positions also takes place. This is carried out through devices formed by the pins 30, which terminate with conical seats 29: when closed, shown in FIG. 3*b*, said conical seats 29 are forced by the compressed springs 31 towards the upper countersink 24 of the shafts 13, thus obtaining the locking and also the centring, thanks to their conical shape.

The mechanical and airtight closing of the small boilers 15 is carried out by locking the individual covers 11 at the upper edges 44 through known means. As can be clearly seen in FIG. 1, the inside of the small boilers 15 has practically no dead zones when the shafts 13 are arranged in it.

Alternatively, partial loads of the dying apparatus 10 are possible, using just a part of the small boilers 15 and shutting off the empty small boilers 15 from the liquid circulation, through the valves 55 and 55'. Different partially loaded situations are thus obtained.

After the quoted closing of the covers 11, the small boilers 15 are filled with the dying liquid. Through the outer pump 16 a circulation of the liquid is promoted, also with the possibility of inverting the direction of the flow in the tubes 70 and 70' through the inverter 60.

The inverter 60 is fed by a piping 19, coming from the heat exchanger 17. Such an inverter 60 is equipped with a known device for addressing the flow inside the boilers 15 through the tubes 70 or 71, according to the desired circulation direction. The flow then crosses the boilers 15 and, through the tubes 71 or 70, respectively, returns to the inverter 60, from which it proceeds towards the pump 16, through a piping 18. The dying liquid is heated or cooled through the heat exchanger 17.

With the dying apparatus 10 it is also possible to rationalise production. Regarding this, in FIG. 5 and FIG. 6*a* a dying line is represented which foresees a trolley 36 where the shafts 13 are circumferentially arranged with the reels to be treated. These shafts 13 are picked up by the crane 35 which lowers them, through the moving device 14, into the dying apparatus 10. After the cycle in the apparatus 10, the series of shafts 13 is picked up by the moving device 14 and is lowered into the centrifugal water draining apparatus 37, which can be with a beehive hoist or with perforated tubes, of a suitable size to host the circumferential series of shafts 13. At the end of this step, the moving device 14 picks up the series of shafts 13 and lowers them into the drier 38, which has a chamber with a circular section of a suitable size for hosting the circumferential series of shafts 13, where the process is completed.

Alternatively, in FIG. 6*b* the production line includes, with respect to FIG. 6*a*, instead of the drier with a chamber having a circular section 38, a traditional drier 40 with a chamber having a rectangular section, for which reason, at the exit from the centrifugal water draining apparatus 37, the circumferential series of shafts 13 is picked up by the moving device 14 and is rested on a trolley 36, which is then taken into the drier 40.

In another alternative, in FIG. 6*c* the production line includes, with respect to FIG. 6*a*, a traditional water draining apparatus 41 and a traditional drier 40 with a chamber having a rectangular section, for which reason, at the exit of the dying apparatus 10, the circumferential series of shafts 13 is picked up by the moving device 14 and is rested upon a trolley 36. From the trolley 36 the individual reels 12 are withdrawn from the shafts 13 and are positioned, manually or mechanically, in the traditional water draining apparatus 41. At the end of the water-draining step the individual reels 12 are picked up and arranged, manually or mechanically, on a trolley 42, which is then taken into the traditional drier 40 with a chamber having a rectangular section, to conclude the treatment process.

It should be noted that the engineering solution realised in FIG. 6*a* is of course the optimal one, because it reduces the manipulations of the reels 12 in the production cycle to the minimum.

The advantage which characterises this particular embodiment of the dying apparatus with a plurality of small vertical boilers is that of receiving the reels to be dyed on individual removable reel holder shafts, arranged on a single circumference. Such shafts can all be removed simultaneously through a circular device with pneumatic pincers, or another known means, and which can therefore be positioned, without intermediate manipulations, firstly in the centrifugal water draining apparatus with a beehive hoist or perforated tubes and then in the drier with a circular chamber.

For this last drying operation, it is very important that the residual humidity of the yarn after the water draining is uniform in all the reels and this, in the case of the apparatus of the present invention, is guaranteed by the fact that the reel holder shafts are arranged on a single circumference, a thing which is not possible in traditional apparatuses or in those with horizontal small boilers.

A further advantage is the rationalisation of production, since the manual transfer operations of the reels from the dying apparatus to the water draining apparatus, and from here to the drier are eliminated. In practice, therefore, the entire batch is dyed, centrifuged and dried without intermediate manipulations of the reels.

Regarding this, the arrangement of the reel holder shafts on a single circumference simplifies enormously the possible automation with robots of the initial loading operation and of the final unloading of the individual reels from the shafts.

The use of the apparatus also with empty small boilers, in a number from two up to about half of the total (arranged symmetrically with respect to the centre to allow a subsequent balanced use of the shafts in the centrifugal water draining apparatus), allows the maximum productive capacity to be fractioned, maintaining the soaking ratio virtually constant: the operative flexibility is therefore at its maximum.

Finally, to treat large batches, apparatuses constructed with a modular structure can be realised, combining or twinning many dying apparatuses according to the present invention.

Moreover, the dying apparatus object of the present invention, still keeping the essential special characteristics of traditional apparatuses, that is working totally full and with inversion of the direction of the circulation liquid, not only substantially reduces its soaking ratio, but furthermore improves its dying capability.

This has been made possible thanks to the innovative arrangement, vertical and circumferential, of the small dying boilers, which practically have no dead zones. The reduction of the soaking ratio leads to the simultaneous reduction in water, energy, steam and chemical product consumption and in polluting atmospheric and environmental discharges.

Moreover, the treatment times are reduced since, with the same flow rate of the pump and with the same heat exchange surface with respect to traditional apparatuses, due to the substantial reduction in the bath volume, increase its cycles per minute as well as its temperature rise gradient, and thus in theory, and compatibly with the characteristic lifetime curves of dyes, the treatment times reduce. Moreover, the increase in the cycles per minute also involves an improvement of the dying capabilities.

The dying apparatus thus conceived is susceptible to modifications and variants, all covered by the invention; moreover, all of the details can be replaced by technically equivalent elements. In practice, the materials used, as well as the sizes, can be whatever according to the technical requirements.

The invention claimed is:

1. Dying or bleaching apparatus for yarn wound on reels or similar packages, with a reduced soaking ratio, comprising a plurality of small treatment boilers (15) closed on a base (48) and equipped with removable closing covers (11), said small boilers (15) being equipped with entry and/or exit tubes (70, 70') for a treatment liquid connected to a circulation pump (16) and to a heat exchanger (17), in each of said small boilers (15) being arranged a removable support shaft (13) in a central position, upon which reels of yarn or similar packages (12) are slotted one on top of the other, characterized in that said small boilers (15) have circular sections, have a vertical axis, and the axes of said small boilers (15) are arranged on a single circumference, each of said support shafts (13) is in a vertical position, and is arranged between housings (29, 25') formed near to each cover (11) and to each base (48), respectively, in which the diameter of the small boilers (15) is larger than the maximum diameter of each of said reels or similar packages (12), said covers (11) are fixed to a covering annular structure (50), moved by an opening or closing device (51, 20, 21, 43) of all the small boilers (15), said entry and/or exit tubes (70, 70') being intercepted by at least two valves (55, 55'), said valves (55, 55') when in operation exclude one or more of the small boilers (15) from the dyeing process, while maintaining a constant soaking ratio.

2. The apparatus according to claim 1, characterized in that said opening and closing device comprises a lever (51), which supports the structure (50) at one end, said level (51) being pivoted with a pin (43) and being actuated by a flip-over cylinder (20).

3. The apparatus according to claim 1 or 2, characterized in that said opening and closing device comprises a cylinder (21), mounted axially on the structure (50), which lowers said covers (11) towards the small boilers (15) until it closes them and at the same time locks the support shafts (13) through the housings (29).

4. The apparatus according to claim 1, characterized in that said covers (11) mechanically and airtightly close upper edges (44) of the small boilers (15) with locking devices with superposed teeth, or with other known means.

5. The apparatus according to claim 1, characterized in that said housings (25', 29) consist of a series of conical seats (25'), formed on the inner bases (48) of the small boilers (15), and arranged on a single circumference which passes through the centre of said boilers, and of a corresponding series of conical seats (29), formed on the covers (11), which, when the covers (11) are closed on the small boilers (15), are coaxial with the vertical axes which pass through each of the conical seats (25') formed on the bases of the small boilers (15).

6. The apparatus according to claim 3, characterized in that said support shafts (13) are equipped below with conical ends (25), suitable for a removable housing in one or more conical seats (25').

7. The apparatus according to claim 3, characterized in that one or more conical seats (29) on the covers (11) are mounted on pins (30) equipped with compensation springs (31), such as to lock, in the act of closing the covers (11) on the small boilers (15), the support shafts (13) in one or more conical seats (25') formed on the bases (48) of the small boilers (15), through countersinks (24) realized at the upper ends of the shaft.

8. The apparatus according to claim 1, characterized in that some of said small boilers (15) are shut off from circulation of the treatment liquid through valves (55, 55') which intercept the tubes (70, 70').

9. The apparatus according to claim 1, characterized in that the flow inverter (60) is foreseen, arranged at the center of the circumference upon which the axes of said small boilers (15) are arranged, to invert the circulation of the treatment liquid in that said support shafts (13) have at the top a grooved end (23) which is suitable for being clamped through devices equipped with pincers (28), moved by small pistons.

10. The apparatus according to claim 1, characterized in that said support shafts (13) have at the top a grooved end (23) which is suitable for being clamped through devices equipped with pincers (28), moved by small pistons (27).

* * * * *